US006668742B2

(12) United States Patent
Nadeau et al.

(10) Patent No.: US 6,668,742 B2
(45) Date of Patent: Dec. 30, 2003

(54) PERSONAL WATERCRAFT WITH STORAGE TRAY

(75) Inventors: Daniel Nadeau, St. Denis-de-Brompton (CA); Luc Bourgeois, Bromont (CA)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 10/218,898

(22) Filed: Aug. 15, 2002

(65) Prior Publication Data

US 2003/0061975 A1 Apr. 3, 2003

Related U.S. Application Data

(60) Provisional application No. 60/325,173, filed on Sep. 28, 2001.

(51) Int. Cl.[7] ..... B63B 35/73
(52) U.S. Cl. ..... 114/55.5; 114/55.53
(58) Field of Search ..... 206/373; 114/55.5, 114/55.53

(56) References Cited

U.S. PATENT DOCUMENTS 4,412,618 A * 11/1983 La Conte ..... 206/581
5,011,013 A * 4/1991 Meisner et al. ..... 206/373
5,669,498 A * 9/1997 Fierek et al. ..... 206/373
2002/0015538 A1 * 2/2002 Snider ..... 383/18
2002/0027091 A1 * 3/2002 Brown ..... 206/372
2002/0088729 A1 * 7/2002 Urbanski ..... 206/373

OTHER PUBLICATIONS

Brochure "Sea–Doo Parts Catalog" GTX DI 5649/5659, 1999, p. A2, B3 to B10 (Apr. 2000).
Brochure "Sea–Doo Parts Catalog" LRV 5688, 1999, p. A2, D5 to D12, E1 and E2 (May 1999).

* cited by examiner

*Primary Examiner*—Stephen Avila
(74) *Attorney, Agent, or Firm*—Pillsbury Winthrop LLP

(57) ABSTRACT

A personal watercraft comprising a hull, an engine disposed in the hull, a propulsion unit operatively adapted to be driven by the engine, and a steering unit operatively adapted to position the propulsion unit. A deck is supported above the hull. The deck has a storage compartment. The storage compartment includes a peripheral wall extending downwardly toward the hull, defining a closed bottom. The peripheral wall defines the storage compartment interior. The uppermost portion of the peripheral wall defines an opening into the storage compartment interior. A storage tray is supported by the deck. The storage tray is disposed vertically above the storage compartment.

22 Claims, 12 Drawing Sheets

PERSONAL WATERCRAFT WITH STORAGE TRAY

This application relies for priority on U.S. Provisional Patent Application Ser. No. 60/325,173, entitled "PERSONAL WATERCRAFT WITH STORAGE TRAY," which was filed on Sep. 28, 2001, the entirety of which is incorporated herein by reference.

BACKGROUND OF THE INVENTION

1. Field of the Invention

The field of the invention relates to personal watercraft. More specifically, the invention relates to personal watercraft that include a front storage compartment.

2. Background of the Invention

Personal watercraft often include a forward storage compartment that is used to store such items as beverage coolers, extra clothes, fire extinguishers, etc. The forward storage compartment is typically a molded element that is attached to the forward portion of the deck of the personal watercraft. Typically, the storage compartment is covered by a cover or hood that is also attached to the deck. In most cases, the cover includes a hinge, which allows the cover to pivot relative to the deck, providing access to the contents of the storage compartment.

Commonly in prior art personal watercraft, the forward storage compartment is constructed so that is offers a relatively large volume, sufficient for storing a large number of items. The forward storage compartment, however, simply is a "bucket" into which items may be placed without regard for any ease of access to those items. While this has satisfied customer demand in the past, little thought was given to a storage compartment that permits at least modest organization of the contents of the storage compartment. Consequently, watercraft riders often have had to rummage through the storage compartment to locate items of interest.

Additionally, watercraft, including personal watercraft, often have not been provided with a convenient carry-all to transport multiple items that are stored in the storage compartment. As a result, watercraft riders often have been required to store a rucksack or other suitable carrying device when they wished to transport multiple items in the storage compartment to a location remote from the personal watercraft.

The "inconvenience" of the design of prior art storage compartments is made apparent in at least two circumstances. First, the watercraft rider may wish to assemble a meal and transport the meal to a remote location, for example a remote beach. Without a convenient carry-all, the rider must also transport a container, basket, or bag to carry the meal from the watercraft, once he or she reaches the desired destination. Second, after a day of riding a watercraft, riders often prefer to quickly remove their personal belongings from the storage compartment so that those belongings may be stored in the rider's home, for example. Often, the items stored in the storage compartment are of the type that the rider will want to store in the storage compartment when he or she next desires to ride the watercraft (e.g., a small anchor, a tie rope, etc.). It is inconvenient to have to remove personal belongings from the storage compartment, place them in a bag for storage remotely from the watercraft, only to have to replace the same items in the storage compartment a few days later.

A need, therefore, has developed for a watercraft, specifically a personal watercraft, that permits some degree of organization for the items that are stored in the forward storage compartment.

A need has also arisen for a convenient carry-all that may be used to transport one or more items from the storage compartment without the need for stowing a separate rucksack or carry-all.

As suggested above, the prior art does not address these needs.

SUMMARY OF THE INVENTION

It is, therefore, an aspect of the invention to provide a storage tray that incorporates features to facilitate at least partial organization of the contents stowed within a storage compartment for use with watercraft, including personal watercraft.

It is another aspect of the invention to provide a simple, cost effective, storage tray for use with watercraft, including personal watercraft.

It is still another aspect of the invention to provide a storage tray that fits conveniently within the front storage compartment of a personal watercraft.

It is yet another aspect of the invention to provide a storage tray for use with a personal watercraft that is easily removed from the watercraft and is easily transported.

In furtherance of the objects, one aspect of the present invention is to provide a personal watercraft comprising a hull, an engine disposed in the hull, a propulsion unit driven by the engine, and a steering unit to steer propulsion unit. A deck is supported above the hull. The deck has a forward storage compartment. The forward storage compartment includes a peripheral wall extending downwardly toward the hull. The peripheral wall defines the storage compartment interior. The uppermost portion of the peripheral wall defines an opening into the storage compartment interior. A storage tray is supported by the deck. The storage tray is disposed vertically above the forward storage compartment.

Other aspects of the invention will be made apparent from the drawings and the description that follows.

BRIEF DESCRIPTION OF THE DRAWINGS

Reference will be made hereinafter to the accompanying drawings, which illustrate embodiments of the present invention discussed herein below, wherein.

DETAILED DESCRIPTION OF EMBODIMENT (S) OF THE INVENTION

Figure 1:
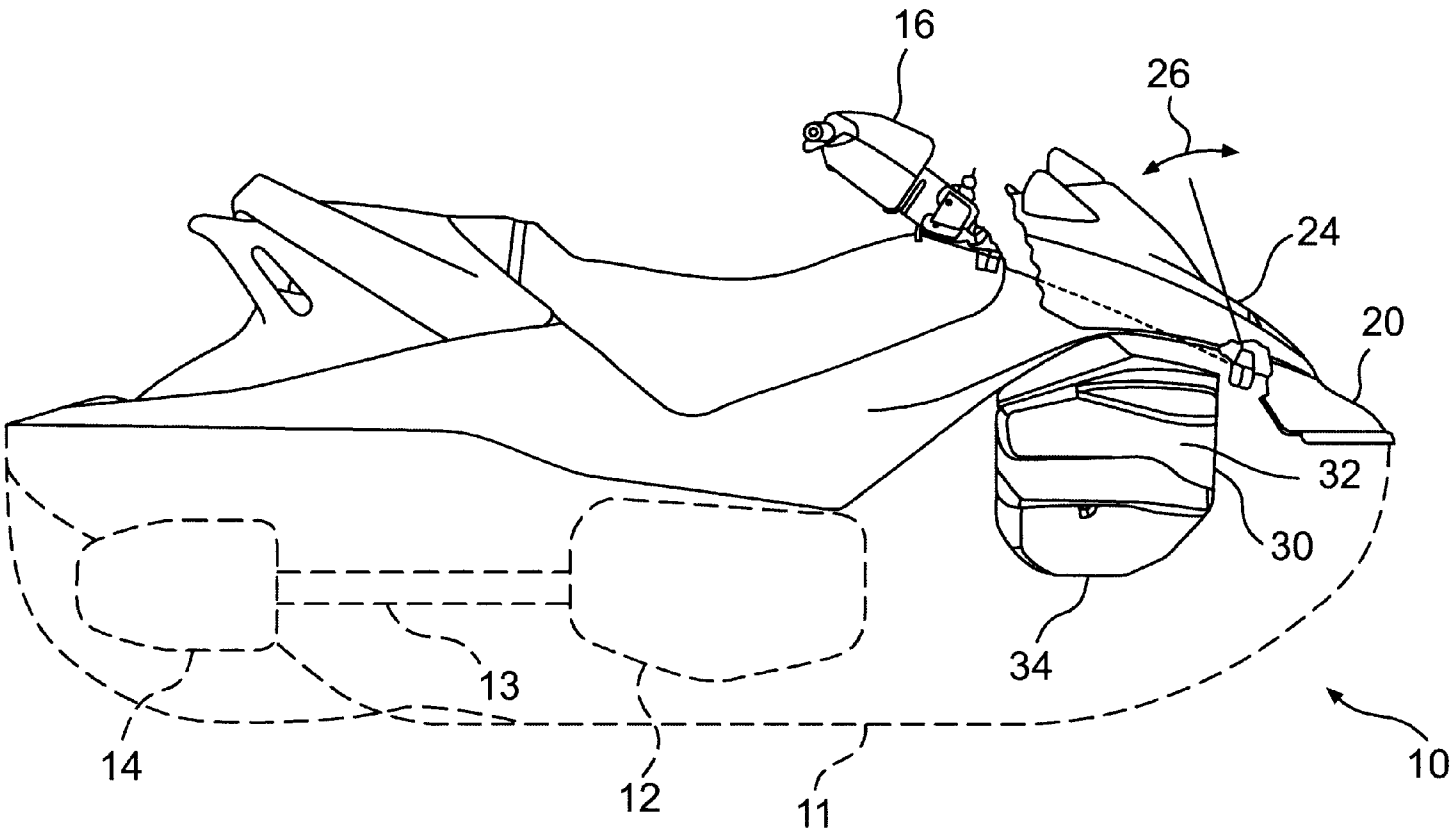
FIG. 1 is a cross sectional side view of a personal watercraft containing the storage compartment of the present invention.

FIG. 1 is a side view showing a personal watercraft 10 having a hull 11, an engine 12 disposed in the hull 11, and a jet propulsion unit 14 disposed in the rear portion of the hull 11. The jet propulsion unit 14 is driven by engine 12 via a drive mechanism such as a drive shaft 13. A steering unit 16 is operatively adapted to position the jet propulsion unit 14 in a manner known in the art to steer the watercraft 10. While a steering handlebar is illustrated as the steering unit 16, those skilled in the art would readily appreciate that any alternate steering device, such as a steering wheel, could be substituted therefor without deviating from the scope and content of the present invention.

Similarly, as would be appreciated by those skilled in the art, the propulsion unit 14 depicted in FIG. 1 is merely exemplary of one construction that may be incorporated into the personal watercraft 10 of the present invention. While it is contemplated that the propulsion unit 14 is a jet propulsion drive powered by an internal combustion engine 12, other types of propulsion units (e.g., propeller-type) and engines (e.g., battery operated, fuel cell, etc.) may be employed without deviating from the scope of the present invention.

In addition, it is contemplated that the invention may be used in connection with any type of watercraft, including boats. In other words, while the invention is shown and discussed in connection with the design and construction of a personal watercraft, it is contemplated that the invention could be readily incorporated into the design of a boat or even a land-going vehicle.

As illustrated in FIG. 1, the personal watercraft of the present invention includes a deck 20 supported above the hull 11. A portion of the deck 20 has been removed in this illustration to reveal a forward storage compartment 30, which is disposed under a hood (or cover) 24. In the illustrated embodiment, the hood 24 is pivotally connected to the deck 20 through a hinge 25 (illustrated in detail in FIG. 3). Accordingly, the hood 24 may be opened and closed in the manner illustrated by arrow 26 to provide access to the forward storage compartment 30.

Figure 2:
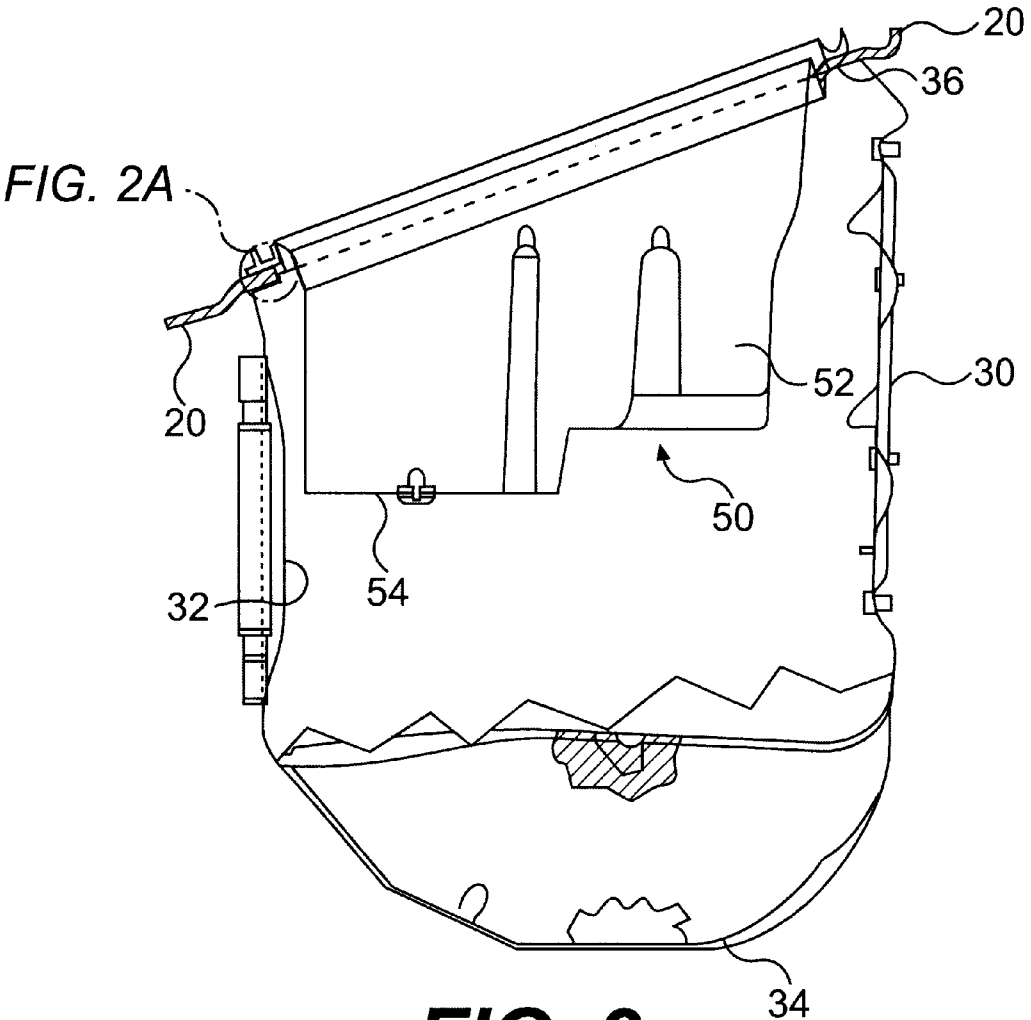
FIG. 2 is side view of a the storage tray of the present invention positioned within the front storage compartment of the personal watercraft shown in FIG. 1.
Figure 2A:
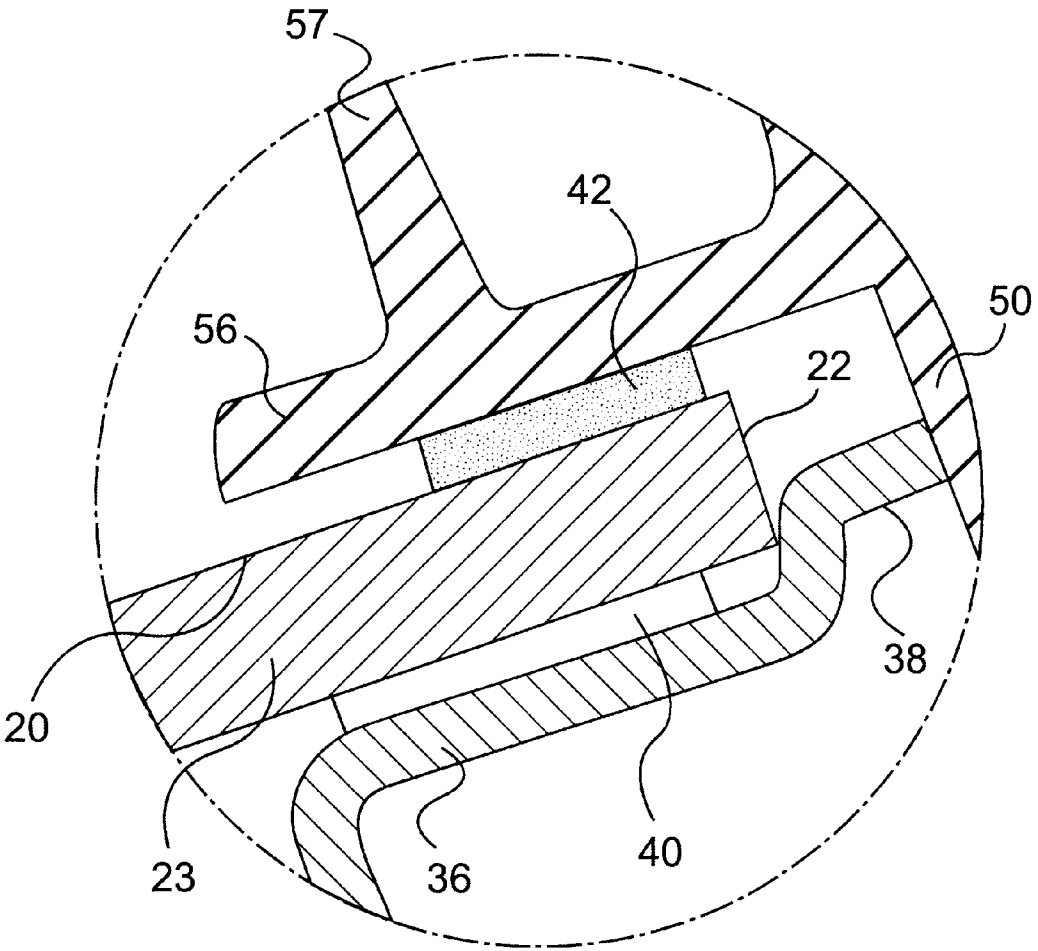
FIG. 2A is an enlarged view of a portion of the watercraft shown FIG. 2 (the enlarge portion being surrounded by circle 2A), illustrating details of one potential construction of the forward end of the storage tray of the present invention as it is supported by the personal watercraft deck.

FIG. 2 illustrates the structure of one embodiment of forward storage compartment 30. FIG. 2A illustrates one manner in which the forward storage compartment 30 may be connected to the deck 20. FIG. 2 also shows an embodiment of the storage tray 50 of the present invention. As illustrated, the storage tray 50 is disposed within the upper portion of the interior of the forward storage compartment 30.

FIG. 2 is a cross-section of the personal watercraft 10 showing the forward storage compartment 30. The forward storage compartment 30 includes a peripheral wall 32 and a closed bottom 34. The peripheral wall 32 further includes an uppermost portion 36, which defines the opening into the interior of the storage compartment 30.

An enlarged cross-section of a portion of the uppermost portion 36 of a forward portion of the peripheral wall 32 is shown in FIG. 2A. As shown in FIG. 2A, the peripheral wall uppermost portion 36 includes a lip 38 which extends inwardly around the perimeter of the forward storage compartment 30.

In the embodiment illustrated, the forward storage compartment 30 is manufactured separately from the deck 20. In particular, the forward storage compartment 30 is manufactured from polyethylene using known blow molding techniques. The deck 20, by contrast, is manufactured from fiberglass using known manufacturing techniques. While these differing manufacturing techniques are described in connection with the construction of the personal watercraft 10, those skilled in the art would readily appreciate that other manufacturing techniques and materials may be used without deviating from the scope of the present invention.

As shown in FIG. 2A, the uppermost portion 36 of the storage compartment 30 is attached to the deck 20 preferably through an adhesive 40. Through the attachment of the storage compartment 30 to the deck 20, it is contemplated that, at least in the embodiment illustrated, the storage compartment 30 is integrated into the deck 20. However, as those skilled in the art would readily appreciate, the deck 20 and the storage compartment 30 need not be manufactured separately. It is possible that the deck 20 and the storage compartment 30 may be manufactured from fiberglass as a single, unitary element In the embodiment illustrated in FIG. 2A, the peripheral wall uppermost portion 36 is attached to the deck 20 proximate to an opening 22 in the deck 20. The deck includes a lip 23 extending around the perimeter of the opening 22. The opening into the storage compartment 30, which is defined by the uppermost portion 36 of the storage compartment peripheral wall 32, is disposed adjacent to deck opening 22. Specifically, the uppermost portion 36 of the storage compartment peripheral wall 32 is attached to the lip 23 formed around the deck opening 22. The lip 38 extending inwardly from the uppermost portion 36 is disposed inwardly of the lip 23.

As is shown in FIG. 2A, the storage tray 50 is supported by the deck 20 adjacent to the location where the uppermost portion 36 of the storage compartment 30 attaches to the deck 20. Accordingly, the storage tray 50 effectively closes off the opening into the storage compartment 30 by totally occluding the opening into the storage compartment 30.

Returning to FIG. 2, the storage tray 50 is shown disposed in the upper portion of the storage compartment 30. The storage tray 50 includes a peripheral wall 52 and a closed bottom 54. An outwardly extending lip 56 is disposed on the tray 50 at the uppermost portion of the peripheral wall 52. The outwardly extending lip 56 is supported by the deck 20 adjacent to the location where the storage compartment 30 is attached to and is integrated into the deck 20.

The support of the storage tray lip 56 by the deck 20 is best shown in FIG. 2A. In FIG. 2A, the lip 56 is shown extending outwardly so as to overlap the uppermost portion 36 of the storage compartment peripheral wall 32 and the lip 23, which extends around the deck opening 22. The peripheral wall 52 of the storage tray 50 abuts the lip 38 to maintain the storage tray 50 in juxtaposition to the deck 20. A seal 42 is disposed on the lip 23 around the periphery of the deck opening 22. The seal 42 prevents water from entering into the interior of the storage compartment 30. The storage tray lip 56 is supported on the seal 42.

In this embodiment, the seal 42 does not permanently attach the storage tray 50 to the deck 20. This permits easy removal of the storage tray 50 from the storage compartment 30. In one embodiment, the seal 42 may comprise a double-sided, non-permanent adhesive. It may also comprise a silicone bead or rubber strip extending around the opening 22. As would be appreciated by those skilled in the art, the precise material that comprises the seal 42 is not critical to the construction of the watercraft 10. To the contrary, any suitable material for the seal 42 may be employed without departing from the scope of the invention.

The storage tray 50 serves as a closure or cover for the storage compartment 30. In the embodiment illustrated in FIG. 2, the storage tray 50 covers the entirety of the deck opening 22 and the opening into the interior of the storage compartment 30. Accordingly, the storage tray 50 assists the hood 24 in one of its functions to prevent water from entering into the interior of the storage compartment 30.

Figure 3:
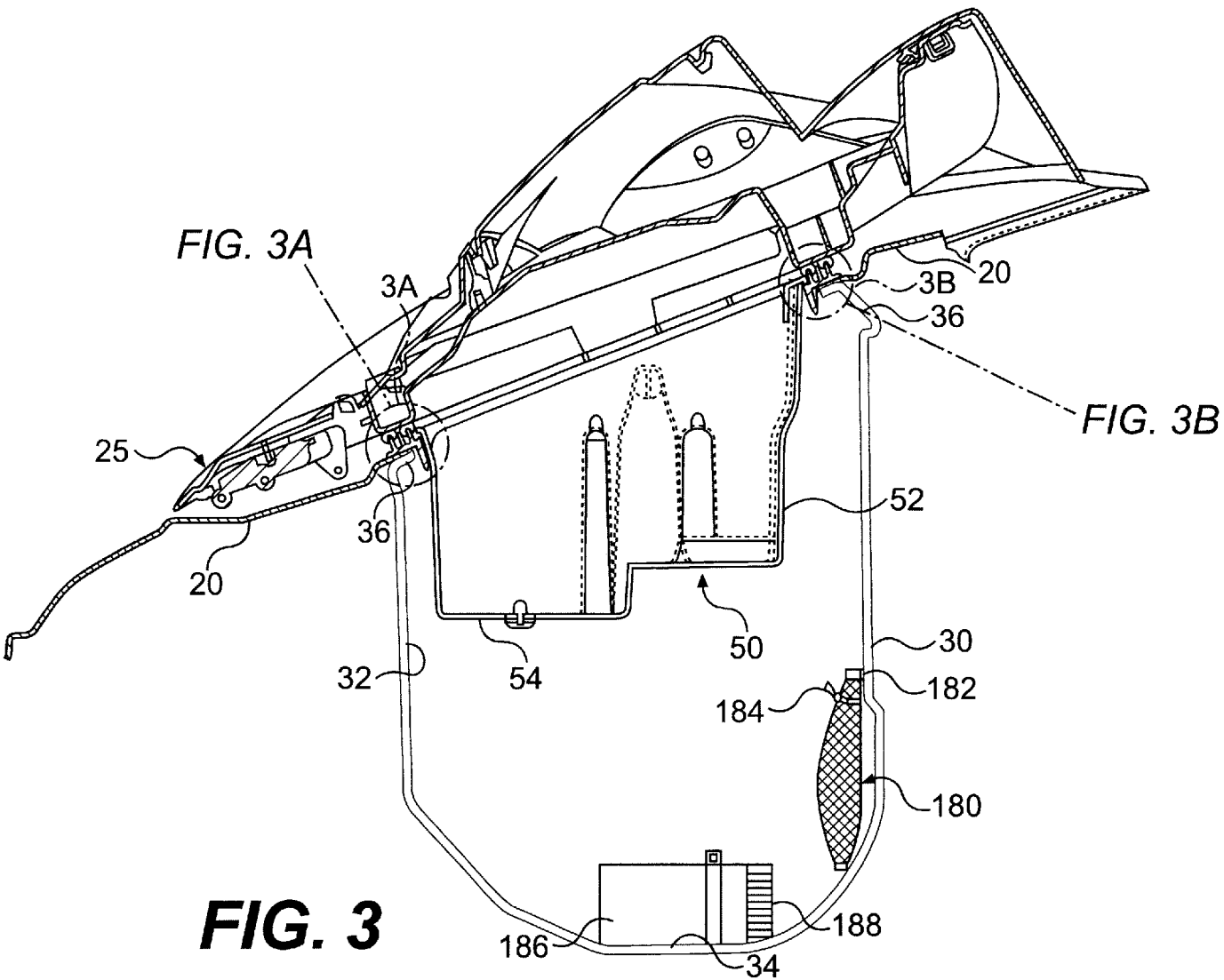
FIG. 3 is a cross-sectional side view of an alternate embodiment of the storage tray of the present invention, also shown disposed within the front storage compartment of the personal watercraft as illustrated in FIG. 1.
Figure 3B:
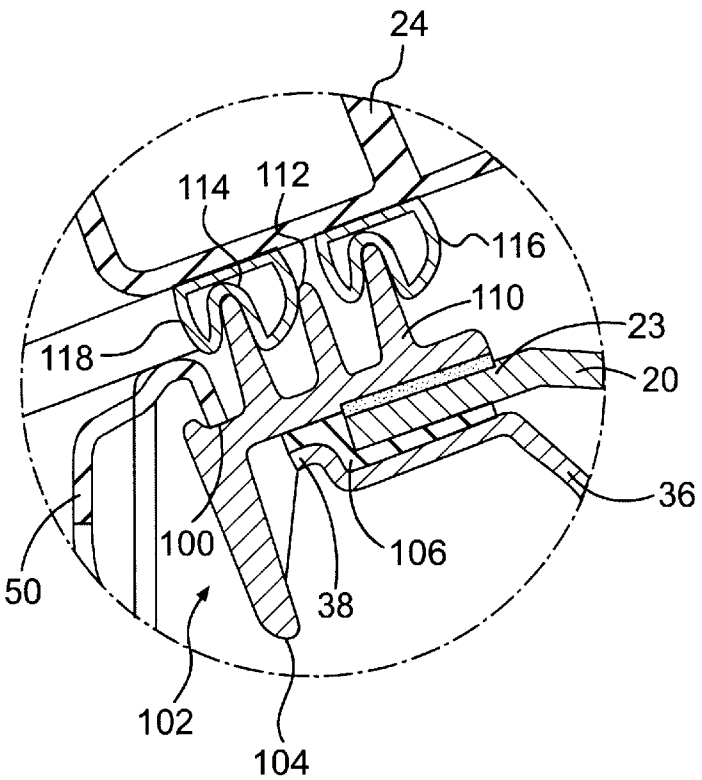
FIG. 3B is an enlarged view of a portion of the watercraft shown FIG. 3 (the enlarged portion being surrounded by circle 3B), illustrating details of the construction of the rearward end of the storage tray of the present invention as it is supported by the personal watercraft deck.
Figure 3A:
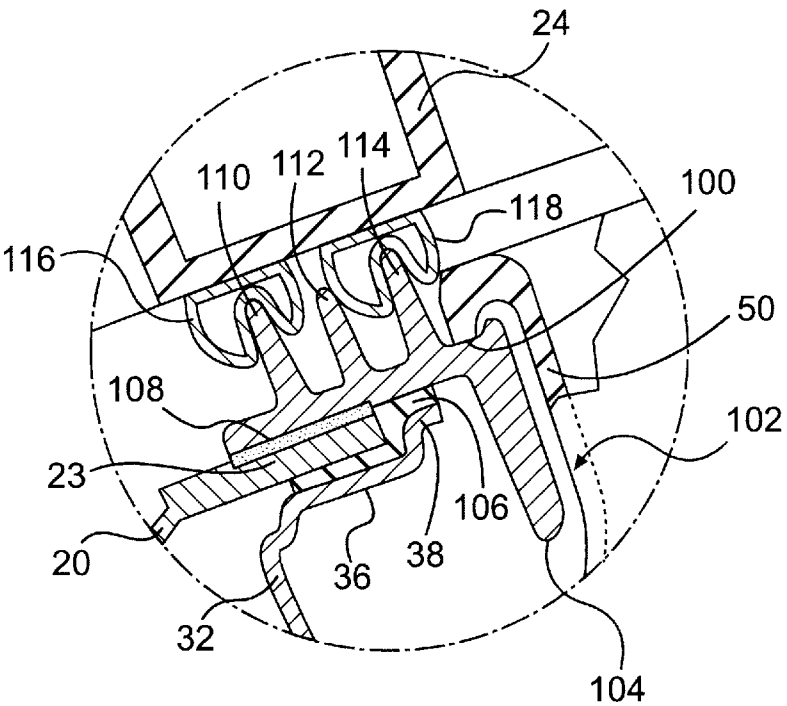
FIG. 3A is an enlarged view of a portion of the watercraft shown FIG. 3 (the enlarged portion being surrounded by circle 3A), illustrating details of another construction of the forward end of the storage tray of the present invention as it is supported by the personal watercraft deck.

FIG. 3 illustrates a second construction between the storage compartment 30 and the deck 20. FIGS. 3A and 3B, which are enlarged details of the construction, provide considerable insight into the particular construction of this embodiment. For the most part, FIG. 3 illustrates many of the same elements depicted in FIG. 2. Variations from the embodiment illustrated in FIG. 2 are discussed in detail below.

Among other features, FIG. 3A illustrates the juxtaposition between the uppermost portion 36 of the storage compartment peripheral wall 32 and the deck 20. In this embodiment, the storage tray defines an upper lip 100. The tray lip 100 rests against a trim element 102 that has a downwardly-extending, inner element 104 that covers the connection between the deck 20 and the uppermost portion 36 of the storage compartment peripheral wall 32. In this embodiment, an adhesive 106 connects the uppermost portion 36 of the storage compartment 30 to the deck 20. A second adhesive 108 (which may or may not be the same type of adhesive as adhesive 106) connects the trim element 102 to the deck 20.

The trim element 102 includes one or more sealing ridges 110, 112, 114 on its upper surface. The sealing ridges 110, 112, 114 engage one or more seals 116, 118 attached to the undersurface of the cover 24. As illustrated, the seals 116, 118 are deformable to provide a water-tight seal when the cover 24 is closed. While three sealing ridges 110, 112, 114 are illustrated, those skilled in the art should readily appreciate that only one sealing ridge 110, 112, 114 is sufficient to provide a water-tight seal. For example, a single-sealing-ridge construction is illustrated in FIGS. 2 and 2A, where only one sealing ridge 57 is provided on the lip 56 of the storage tray 50. Moreover, while two seals 116, 118 are illustrated, those skilled in the art should appreciate that only one such seal is need to assist in maintaining the interior of the storage compartment 30 in a water-free condition. In addition, while sealing ridges 110, 112, 114 and seals 116, 118 are shown as one embodiment of the sealing mechanism between the cover 24 and the deck 20, other arrangements that perform the same function are contemplated to fall within the scope of this invention.

In the embodiment illustrated in FIGS. 3A and 3B, the sealing ridges 110, 112, 114 are made of a rigid material to sealingly engage the seals 116, 118. As would be appreciated by those skilled in the art, however, the sealing ridges 110, 112, 114 may be deformable. In addition, while the seals 116, 118 are shown attached to the underside of the cover 24, and the sealing ridges 110, 112, 114 are shown attached to the deck 20, the position of these members could be switched. In other words, the sealing ridges 110, 112, 114 may be attached to the underside of the cover 24 and the seals 116, 118 may be attached to the deck 20 without departing from the scope and spirit of the invention.

FIG. 3B illustrates the sealing engagement between the trim element 102 and the cover 24. As shown, the sealing structure is the same as that illustrated in FIG. 3A, except that the arrangement is essentially a mirror-image of that shown in FIG. 3A. The reason for this is simple: the sealing structure extends around the periphery of the opening 22 in the deck 20. Therefore, the orientation of the sealing structure at the rear edge of the storage compartment 30 is opposite to that at the front edge.

Figure 4:
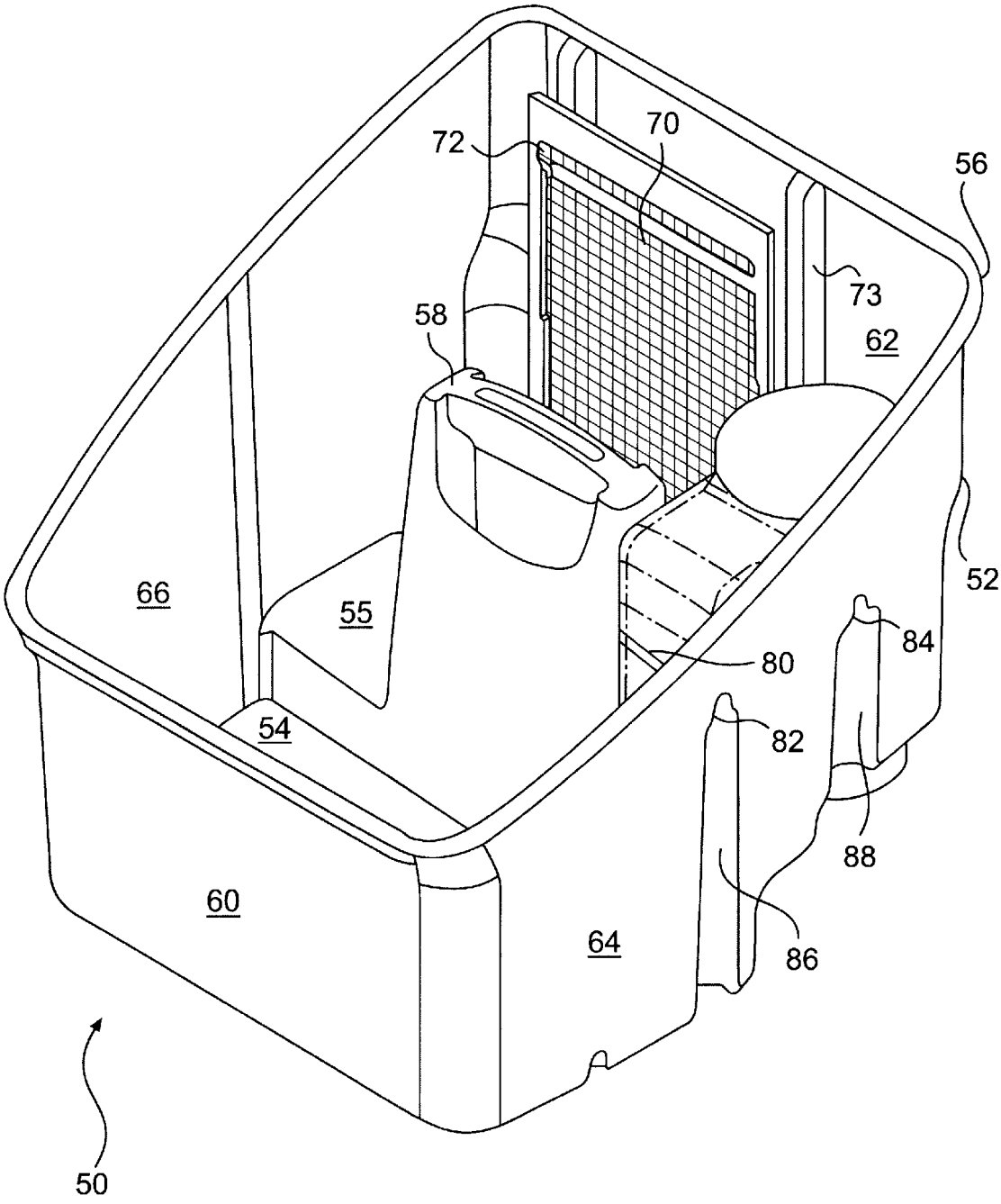
FIG. 4 is a perspective illustration of the storage tray of the present invention as illustrated in FIGS. 2 and 3.
Figure 5:
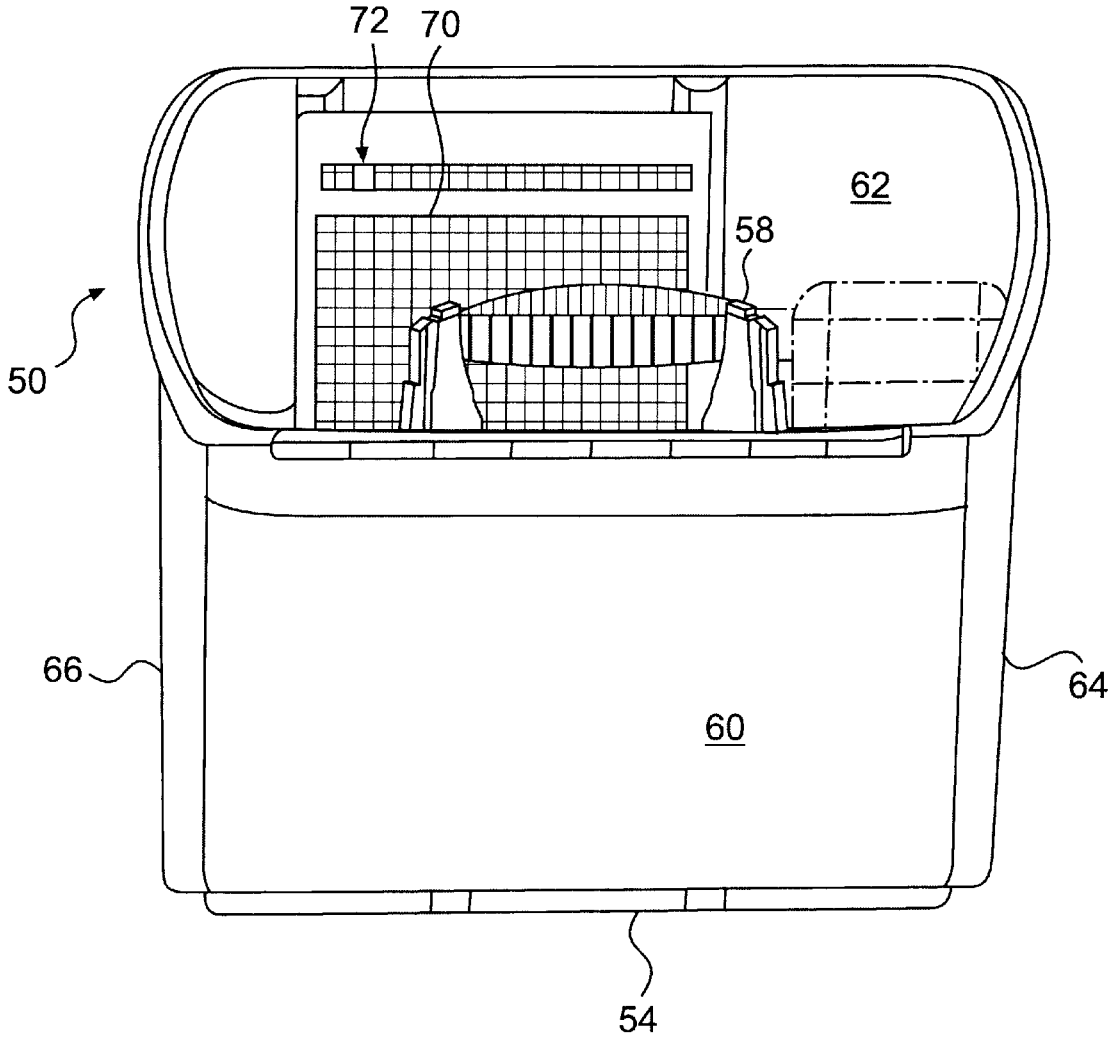
FIG. 5 is a front view of the storage tray illustrated in FIG. 4.
Figure 6:
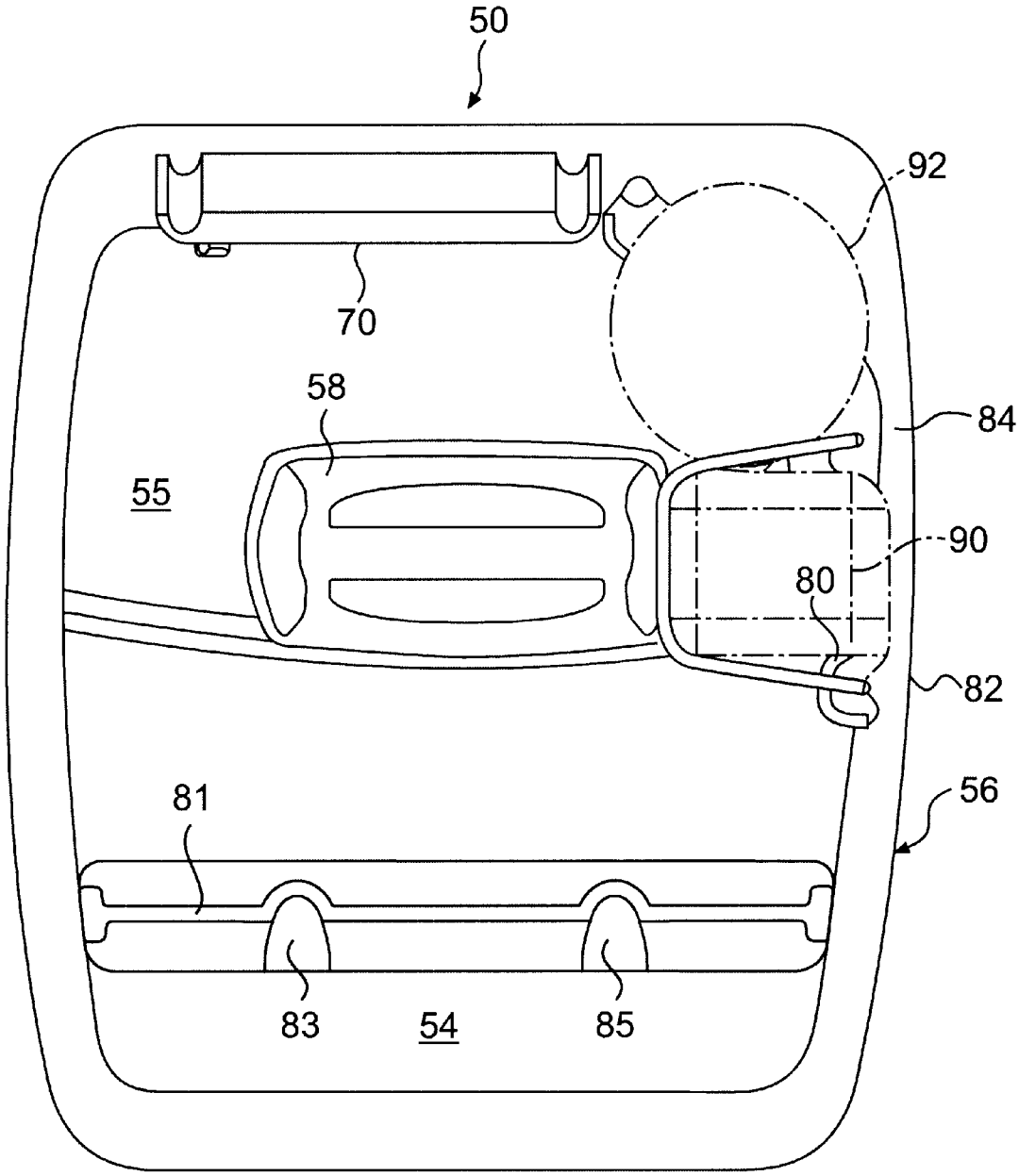
FIG. 6 is a top view of the storage tray illustrated in FIG. 4.

FIGS. 4, 5, and 6 show the storage tray 50 in greater detail. FIG. 4 is a perspective view of the storage tray 50 showing the peripheral wall 52, the closed bottom 54, 55, and the outwardly extending lip 56, which is disposed at the uppermost portion of the peripheral wall 52. The lip 56 extends around the perimeter of the storage tray 50. FIG. 4 also shows that the storage tray 50 includes an integral handle 58, which extends upwardly from the central portion of the storage tray bottom 54. The storage tray peripheral wall 52 is shown with a front wall 60, a back wall 62, a first side wall 64 and a second side wall 66. As discussed above, the storage tray 50 is manufactured from known injection-molding techniques.

As shown in FIGS. 3 and 4 for example, the bottom of the storage tray 50 has two levels 54, 55 of differing heights. The levels 54, 55 are roughly equidistant from the topmost portion of the storage compartment, which is angled upwardly from the front to the rear. This construction, therefore, facilitates access to the contents of the storage tray 50 regardless of the location of the contents within the tray 50. In other words, a rider is not presented with a deeper portion of the tray 50 at either the front or the rear (as measured from the top of the storage tray). The lower level 54 is designed to readily accept a beverage cooler therein, if desired.

As is shown in FIGS. 4 and 5, a pocket 70 is provided in the storage tray 50. The pocket 70 is manufactured from mesh or vinyl (or any other suitable material) and is attached to the back wall 62. A zipper 72 serves as the closure for pocket 70. Alternatively, other closures such as hook and loop fasteners and snaps could be used without departing from the scope of the present invention. The pocket 70 can be attached to the storage tray 50 through any suitable means such as the fasteners 73 or through the use of straps or cords. The pocket 70 is illustrated in an exaggerated spaced-apart position relative to the back wall 62 in FIG. 4, so as to reveal the fastener elements 73.

FIG. 6 shows an elastic cord 80 secured to the first side wall 64. The elastic cord 80 includes a first end 82 disposed in a first indentation 86, and a second end 84 disposed in a second indentation 88. A container 90 is secured to the first side wall 64 by the elastic cord 80. FIG. 6 further shows a storage location 92, which may be used for a nautical safety kit (whistle, rope, etc).

FIG. 6 also depicts a cooler retention channel 81 disposed within the closed bottom 54 of the storage tray 50. The cooler retention channel 81 is a channel that extends the entire width of the closed bottom 54. The cooler retention channel 81 includes two tabs 83, 85 that extend into the cooler retention channel 81.

The cooler retention channel 81 is designed to accept a standard elastic cord therein. A standard elastic cord, which is more commonly referred to as a bungee cord, typically consists of an elastic cord with hooks affixed at either end. The elastic cord portion of the standard elastic cord is designed to hook under one or both of the tabs 83, 85. The tabs, therefore, retain the elastic cord against the closed bottom 54 of the storage tray 54.

With the elastic cord held under one or both of the tabs 83, 85, the ends with the hooks are left free to extend around an item, such as a cooler, placed within the portion of the storage tray 50 defined by the closed bottom 54. If the cooler is wide enough to extend nearly the entire width of the closed area 54 of the storage tray 50, it is contemplated that the elastic cord will be retained by both of the tabs 83, 85. However, if the cooler placed on the closed bottom 54 does not extend the full width of the storage tray 50, it is contemplated that the elastic cord will be retained by only one of the tabs 83, 85.

As would be appreciated by those skilled in the art, a greater or fewer number of tabs 83, 85 may be provided in the closed bottom 54 of the storage tray 50, if desired. Moreover, while it is contemplated that the tabs 83, 85 are integrally molded as a part of the closed bottom 54, those skilled in the art would readily appreciate that the tabs 83, 85 may be replaced by hooks (or other suitable fasteners) without departing from the scope of the present invention.

As should be appreciated by those skilled in the art, the particular arrangement of the storage tray 50 depicted in FIGS. 4–6 is merely exemplary of one possible embodiment of the storage tray 50. Numerous alternative embodiments for the storage tray 50 are contemplated to fall within the scope of the invention.

One particular feature of the storage tray 50 that is of particular note is the handle 58 disposed at roughly the center of the storage tray 50. The handle 58 is positioned at this location so as to be surrounded by the remaining parts of the storage tray 50. In this manner, the handle 58 is positioned so that the storage tray 50 is balanced when removed from the storage compartment 30. A balanced tray 50 is more easily transported to a remote location after it has been removed from the storage compartment. Moreover, a centrally-located handle 58 facilitates removal of the tray 50 regardless of the location of the rider in relation to the watercraft 10.

FIGS. 7–10 illustrate four alternate embodiments of the storage compartment 30 shown in FIGS. 1–3.

Figure 7:
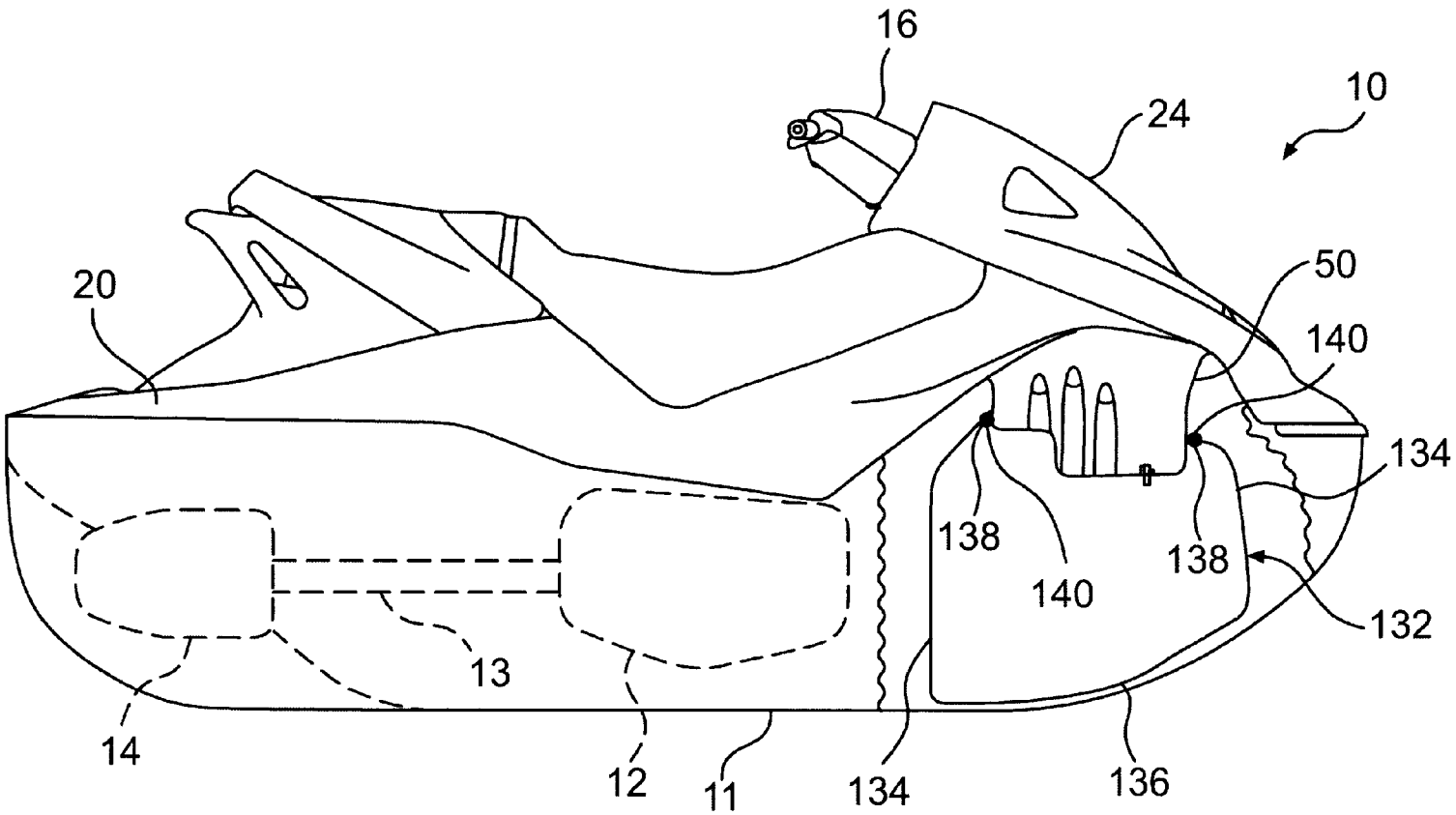
FIG. 7 is a cross-sectional side view of the personal watercraft of the present invention, illustrating yet another embodiment for the storage compartment therein.

In particular, FIG. 7 illustrates the personal watercraft 10 with an enlarged storage compartment 132. As shown, the storage compartment 132 extends forwardly and rearwardly of the peripheral wall of the storage tray 50. While not illustrated, the storage compartment 132 also extends to the port and starboard sides of the storage tray 50. Of course, as would be appreciated by those skilled in the art, the storage compartment 132 need not extend from the storage tray 50 in each of the bow, stern, port and starboard directions. Space limitations permitting, the storage compartment 132 could extend in only one or more of the watercraft's longitudinal and/or latitudinal directions without deviating from the scope and spirit of the invention.

In the embodiment illustrated in FIG. 7, the storage compartment 132 has side walls 134 and a bottom 136. The topmost portion of the side walls 134 defines an opening 138 through which the storage tray 50 passes so that at least a part of the storage tray 50 extends into the storage compartment 132. A seal 140 extends around the periphery of the topmost portion of the side walls 134 adjacent the opening 138. The seal 140 engages the side walls of the storage tray 50 to create a water-tight seal between the storage tray 50 and the storage compartment 132. This discourages water from entering the storage compartment 132 during operation of the watercraft 10.

The storage compartment 132 may be affixed to the hull 11 by any conventional fastener. While not limited to a particular fastener, an adhesive is contemplated as one means by which the storage compartment 132 is affixed to the hull 11. As would be appreciated by those skilled in the art, however, the storage compartment 132 alternatively may be affixed to any number of structures internal to the hull 11 by conventional fasteners, such as bolts, screws, rivets, etc.

Figure 8:
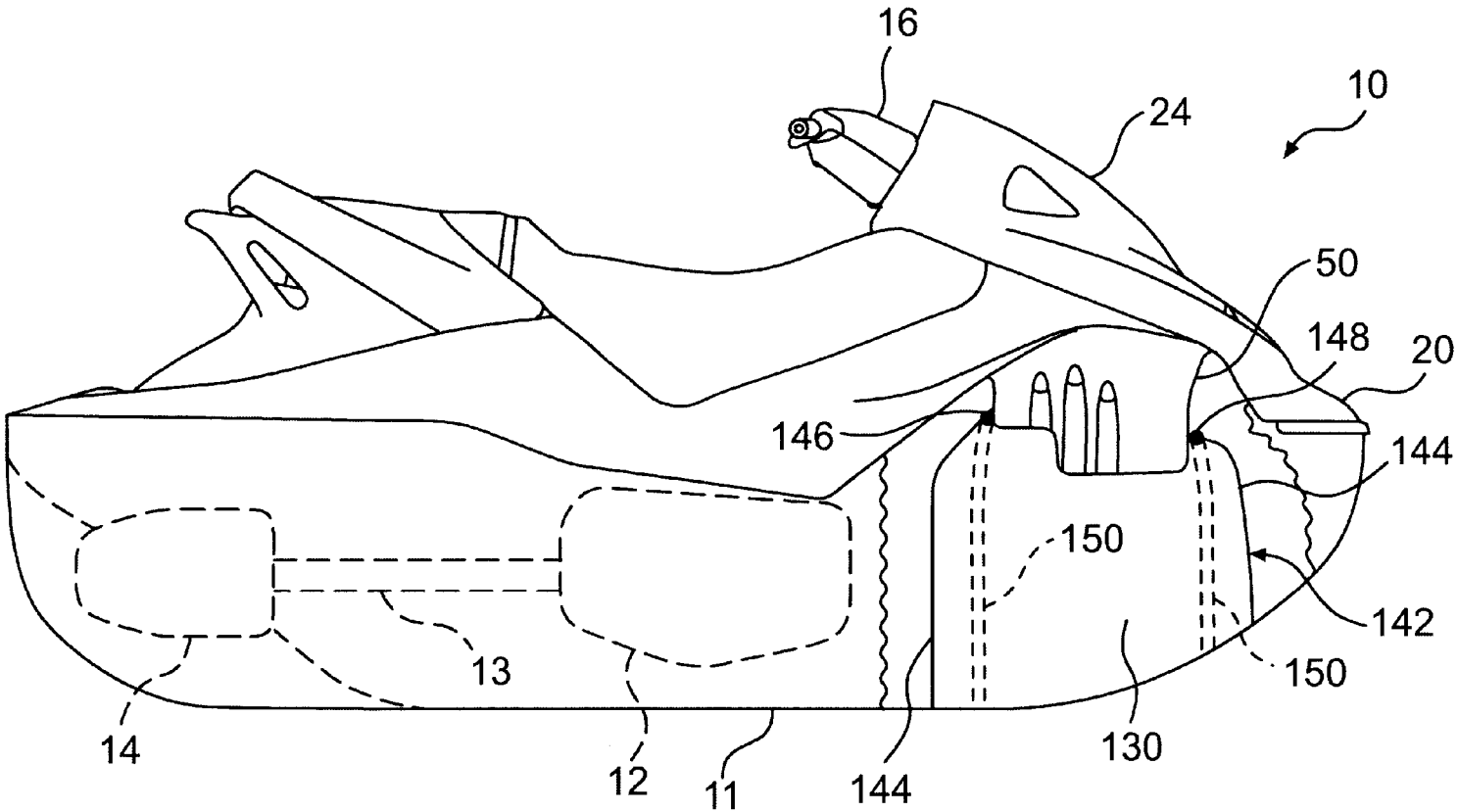
FIG. 8 is a cross-sectional side view of the personal watercraft of the present invention, illustrating a variation of the embodiment of the storage compartment illustrated in FIG. 7.

FIG. 8 illustrates a variation of the storage compartment 132 illustrated in FIG. 7. In FIG. 8, the storage compartment 142 has side walls 144 that extend from the opening 146 to the hull 11. As in the previous embodiment, the topmost portions of the side walls 144 are provided with a seal 148 to establish a water-tight seal with the storage tray 50. As in the previous embodiment, the storage tray 50 is removable from the watercraft 10. Removal of the storage tray 50 exposes the interior of the storage compartment 142.

In the embodiment illustrated in FIG. 8, the side walls 144 of the storage compartment 142 are rigid and attach to the hull 11 via a conventional fastener such as an adhesive or a sealing compound. The use of an adhesive (or other suitable sealing compound) provides a water-tight seal at the connection point between the side walls 144 and the hull 11 to assure that the interior of the additional storage compartment 142 is maintained in a substantially water-free condition.

The storage compartment 142 differs from the storage compartment 132 in that it utilizes the bottom of the hull 11 as part of the storage compartment 142. Not only does this maximize the space available in the watercraft 10 beneath the storage tray 50, but the overall weight of the watercraft 10 may be reduced because the storage compartment 142 does not include a separate, bottom wall.

While it is contemplated that the side walls 144 are rigid, the side walls 144 of the storage compartment 142 alternatively may comprise a flexible material, such as a flexible plastic sheet. Alternatively, the side walls 144 may be made from a fabric treated to discourage water from passing therethrough so that the interior of the storage compartment 142 is maintained in a substantially water-free condition. While these materials are suggested, those skilled in the art would readily appreciate that there are many other types of flexible, water-repellant materials that may be available for the construction of the side walls 144.

If the side walls 144 are constructed of a flexible material, the walls 144 may be collapsible so that the side walls 144 rest against the bottom of the hull 11 when not engaging the storage tray 50. In such a case, a support frame 150 (illustrated in dotted lines in FIG. 8 to indicate the alternate construction) extends from the hull 11 to the seal 148. The seal may be disengaged from the frame 150 so that the side walls collapse against the hull 11. With such a construction, it is possible that the engine 12 and components forward of the engine 12 (such as the fuel tank and the fuel pump, among others) may be more readily accessible for maintenance through the opening 146. This construction, therefore, may greatly enhance the ability to repair the engine 12 and the peripheral components forward of the engine 12 without having to remove the engine 12 or parts of the engine 12 from the hull 11.

Alternatively, while not illustrated, the side walls 144 of flexible material may be constructed to extend from the hull 11 to the deck 20. With such a construction, it is contemplated that the side walls 144 could be disengaged from the deck 20 to permit access to the engine 12 and the peripheral components forward of the engine 12 through the opening 146.

Figure 9:
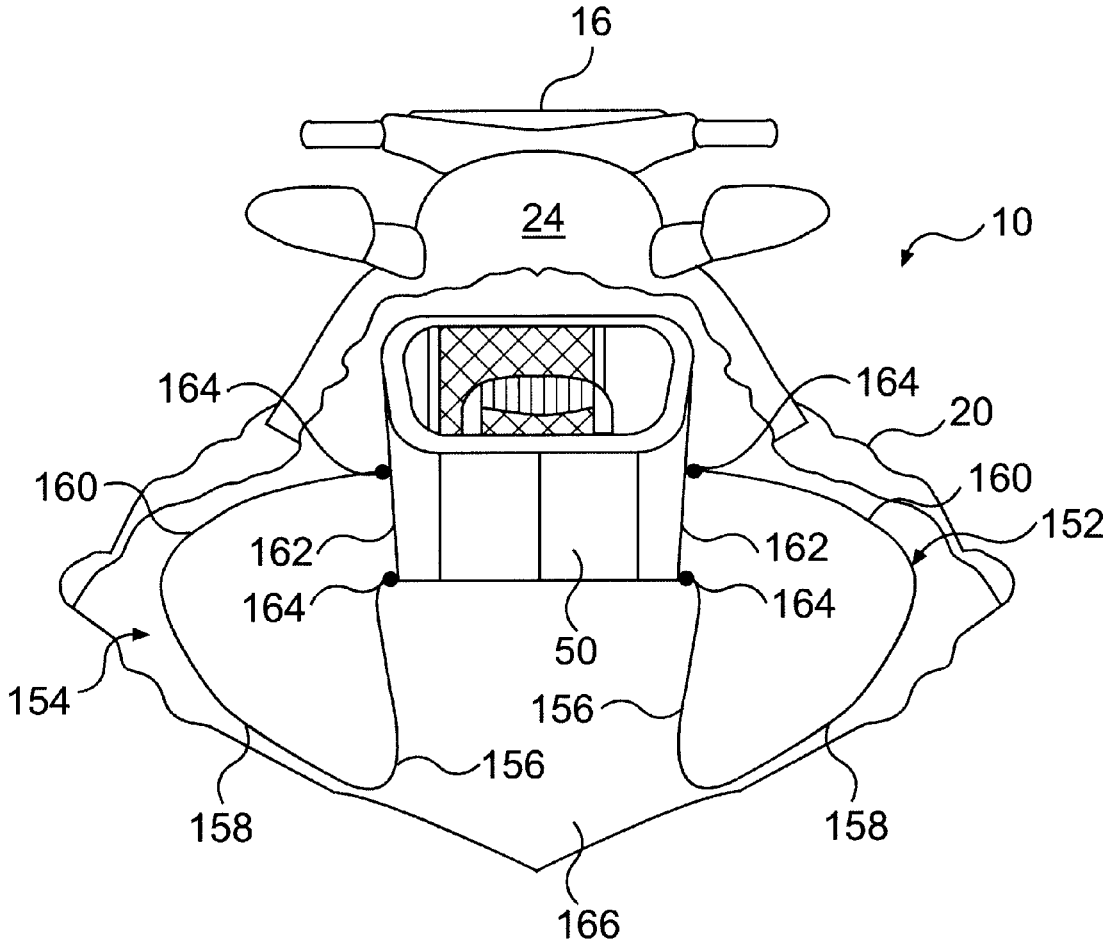
FIG. 9 is a cross-sectional front view of the personal watercraft of the present invention, illustrating another alternative embodiment for the storage compartment therein.

FIG. 9 is a cross-sectional front view of the watercraft 10, illustrating a second way to enhance the storage capacity of the watercraft 10. In this embodiment, two or more side storage compartments 152, 154 are positioned adjacent the port and starboard sides of the removable storage tray 50. The port storage compartment 152 includes a side wall 156, a bottom wall 158, and a top wall 160, which are integrally formed as a single unit. An opening 162 extends through the side wall 156. The edges to the opening 156 are ringed with a seal 164. The seal 164 engages the peripheral sides of the storage tray 50 to provide a water-tight barrier. The starboard storage compartment 154 is constructed in the same manner, except that it is a mirror image of the port side storage compartment 152.

With the port and starboard storage compartments 152, 154 arranged in this manner, after removal of the storage tray 50, the interiors of both side compartments 152, 154 are accessible. In addition, since the central portion 166 of the watercraft 10 does not contain any storage compartment(s), the space may be accessible for purposes of maintaining the forward end of the engine 12 and any peripheral components located near the forward end of the engine 12. In particular, it is contemplated that the fuel tank and fuel pump, among other peripheral components, are two of the peripheral components of the engine 12 that may be accessible after removal of the storage tray 50.

Figure 10:
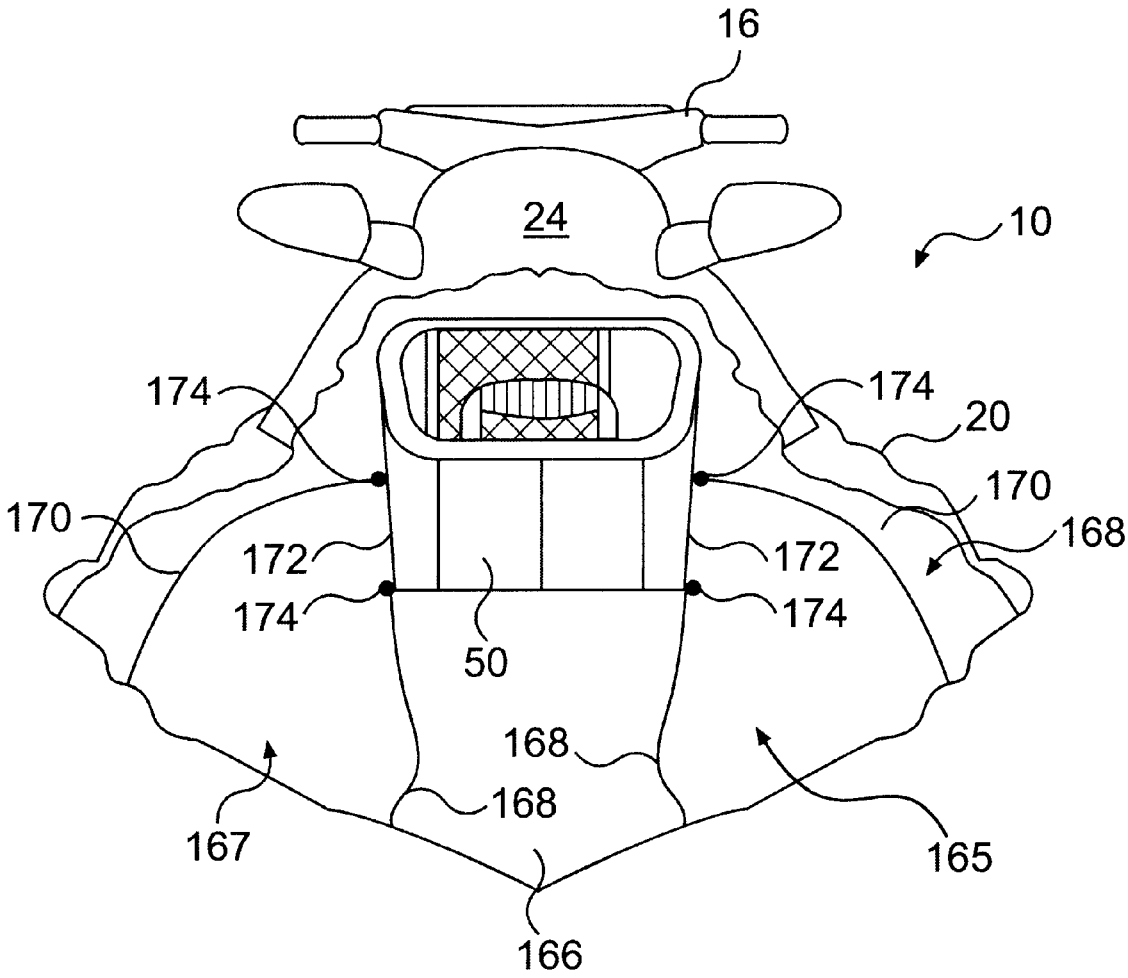
FIG. 10 is a cross-sectional front view of the personal watercraft of the present invention, illustrating a variation of the embodiment of the storage compartment illustrated in FIG. 9.

FIG. 10 illustrates a variation of the side storage compartments illustrated in FIG. 9. Here, like the storage compartment 142 illustrated in FIG. 8, the side storage compartments 165, 167 do not include a bottom wall 158. Instead, the side walls 168 and the top walls 170 are affixed to the hull 11. The walls 168, 170 define an opening 172 therethrough that is surrounded by a seal 174 to provide water-tight engagement with the peripheral walls of the storage tray 50. In the illustrated embodiment, the walls 168, 170 are rigid. However, they may be flexible, as discussed in connection with the storage compartment 142. As in the previous embodiment, the walls 168, 170 may be attached to the hull 11 via a suitable adhesive or sealing compound.

While the port and starboard additional storage compartments 152, 154, 165, 167 extend only laterally to the storage tray 50, those skilled in the art will readily appreciate that the compartments 152, 154, 165, 167 may extend to fill a space forward or rearward to the storage tray 50, space permitting.

Additionally, while the walls of the additional storage compartments 132, 142, 152, 154, 165, 167 have been described as being either rigid or flexible, it is contemplated that the walls could be a combination of both. For example, the bottom portions of the walls could be rigid while the top portions of the walls could be flexible. This hybrid approach to the construction of the additional storage compartments 132, 142, 152, 154, 165, 167 is also considered to fall within the scope of the present invention.

It is noted that the removable storage compartment 30 and the storage tray 50 both have smaller upper openings than the opening 22 in the deck 20 that permits access to the interior of the watercraft 10. This permits the storage tray 50 to be removed from the storage compartment 30 and the removal of the storage compartment 30 from the watercraft 10.

In each of the figures, the storage tray 50 is shown of a size that totally occludes the opening to the storage compartment 30. While this construction provides the maximum storage capacity for the storage tray 50, it is contemplated that the storage tray 50 need not cover the entire opening to the storage compartment 30. To the contrary, the storage tray 50 may be constructed to cover only a portion of the opening to the storage compartment 30. While a smaller storage tray 50 provide less storage capacity, the smaller tray 50 would permit immediate visual inspection of the contents of the storage compartment 30 when the cover 24 is opened. A small storage tray 50, therefore, offers advantages to the present invention and, as a result, is contemplated to fall within the scope of this invention.

Similarly, both the storage tray 50 and the storage compartment 30 may have upper openings smaller than the opening 22 in the deck 20. This construction permits immediate access to the interior of the hull 11 when the cover 24 is opened. Since this also provides certain advantages, the smaller tray 50 and storage compartment 30 are also contemplated to fall within the scope of this invention.

FIG. 3 illustrates one further aspect of the present invention. In particular, FIG. 3 shows the inclusion of a flexible storage bag 180 attached to a side wall 32. The flexible storage bag 180 is secured to the interior of the side wall of the storage compartment 30 via a connector 182. The connector 182 includes one or more fasteners (not shown) so that the storage bag 180 may be readily detached therefrom. In the embodiment illustrated, the storage bag 180 is constructed of a flexible mesh material so that the contents thereof are readily discernable without having to open the bag 180. Alternatively, the bag 180 could be constructed from a plastic cellophane material to accomplish the same goal. As illustrated, a zipper 184 is a suitable closure device for the bag 180. As would be appreciated by those skilled in the art, any other suitable flexible material (e.g., opaque plastic) or any other closure (such as snaps or buttons) may be employed without deviating from the invention.

FIG. 3 also illustrates another aspect of the present invention. At the bottom of the storage compartment 30, a rigid container 186 may be fastened to the bottom wall 34. In the illustrated embodiment, the rigid container is a cylinder with a screw top 188. A flexible retainer 190 holds the container 186 against the bottom wall 34 of the storage compartment 30 to prevent the container 186 from being jostled about during operation of the watercraft 10.

While the bag 180 and the container 186 are shown attached to specific walls 32, 34 of the storage compartment 30, it is contemplated that the bag 180 and container 186 may be attached to any suitable part of the walls 32, 34 of the storage compartment 30 without departing from the scope of this invention. The locations illustrated are meant to be exemplary. They are not meant to limit the scope of the invention.

While the invention has been described with reference to a preferred embodiment, it will be understood by those skilled in the art that various changes may be made and equivalents may be substituted for elements thereof without departing from the spirit and scope of the present invention. In additional, many modifications may be made to adapt a particular situation, component, or material to the teachings of the present invention without departing from its teachings as claimed.

What is claimed:

1. A personal watercraft comprising:

a hull;

an engine disposed in the hull;

a propulsion unit driven by the engine;

a steering unit to steer the propulsion unit;

a deck supported on the hull;

a storage compartment enclosed by the deck and hull, the storage compartment including a peripheral wall extending between the deck and hull defining an interior accessible through an opening; and a storage tray supported by the deck, the storage tray being disposed vertically above the storage compartment and being positioned to occlude at least a portion of the opening into the interior of the storage compartment.

2. The personal watercraft of claim 1, wherein:

the storage compartment further comprises a bottom wall disposed above the hull.

3. The personal watercraft of claim 1, wherein:

a portion of the hull comprises a bottom wall of the storage compartment.

4. The personal watercraft of claim 1, further comprising:

a moveable cover disposed over an opening through the deck, the opening permitting access to the interior of the storage compartment.

5. The personal watercraft of claim 1, wherein:

the storage tray comprises an outwardly extending lip supported by the deck.

6. The personal watercraft of claim 5, wherein:

the storage tray comprises a peripheral wall and a closed bottom, and the outwardly extending lip extends from an uppermost portion of the peripheral wall of the storage tray.

7. The personal watercraft of claim 6, wherein:

the outwardly extending lip extends around the perimeter of the storage tray.

8. The personal watercraft of claim 4, wherein:

an uppermost portion of the storage compartment peripheral wall is secured to the deck adjacent to the deck opening and to define the storage compartment opening.

9. The personal watercraft of claim 8, wherein:

the storage tray totally occludes the opening into the storage compartment.

10. The personal watercraft of claim 4, wherein:

the opening into the storage compartment lies between the deck and the hull.

11. The personal watercraft of claim 10, wherein:

the storage tray totally occludes the opening into the storage compartment.

12. The personal watercraft of claim 4, wherein:

the storage compartment comprises a plurality of storage compartments, all of which have openings that lie between the deck and the hull.

13. The personal watercraft of claim 12, wherein:

the storage tray totally occludes the openings into the plurality of storage compartments.

14. The personal watercraft of claim 4, wherein the storage tray totally occludes the deck opening.

15. The personal watercraft of claim 1, wherein:

at least a portion of the peripheral wall of the storage compartment comprises a flexible material.

16. The personal watercraft of claim 15, wherein the flexible material is at least one selected from a group comprising:

a plastic sheet, a woven fabric, and a water-resistant fabric.

17. The personal watercraft of claim 1, wherein the storage tray comprises a peripheral wall and a closed bottom.

18. The personal watercraft of claim 17, wherein the storage tray further comprises a handle extending upwardly from the closed bottom.

19. The personal watercraft of claim 18, wherein the handle is disposed at a central portion of the closed bottom.

20. The personal watercraft of claim 1, wherein the storage tray comprises:

a peripheral wall;

a closed bottom; and a flexible pocket secured to the peripheral wall.

21. The personal watercraft of claim 1, wherein the storage tray comprises:

a peripheral wall; and at least one elastic cord secured at first and second ends to the peripheral wall, wherein the elastic cord is adapted to secure items thereunder.

22. The personal watercraft of claim 19, wherein:

the storage tray peripheral wall includes at least first and second indentations which extend into the interior of the tray; and the first end is secured to the peripheral wall within the first indentation and the second end is secured within the second indentation.

* * * * *